United States Patent [19]

Lyras et al.

[11] Patent Number: 4,854,419

[45] Date of Patent: Aug. 8, 1989

[54] PARTICULATE CONTAINMENT CONTROL METHOD AND PLATFORM DEVICE

[76] Inventors: Louis G. Lyras, 2220 Stewart Rd.; Gus G. Lyras, 676 S. Hubbard Rd., both of Lowellville, Ohio 44436

[21] Appl. No.: 286,266

[22] Filed: Dec. 19, 1988

[51] Int. Cl.[4] ..... E04G 21/30

[52] U.S. Cl. ..... 182/129; 182/138; 182/150

[58] Field of Search ..... 182/150, 129, 137, 138, 182/139

[56] References Cited

U.S. PATENT DOCUMENTS

| | | | |
|---|---|---|---|
| 597,818 | 1/1898 | Fondu | 182/138 |
| 3,533,487 | 10/1970 | Norin | 182/138 |
| 3,805,816 | 4/1974 | Nolte | 182/138 |
| 4,119,176 | 10/1978 | Verdu | 182/38 |
| 4,276,959 | 7/1981 | Barber | 182/150 |
| 4,660,680 | 4/1987 | Potin | 182/150 |
| 4,732,234 | 3/1988 | Brickman | 182/138 |
| 4,805,735 | 2/1989 | Anderson | 182/138 |

FOREIGN PATENT DOCUMENTS

| | | | |
|---|---|---|---|
| 1482175 | 4/1967 | France | 182/138 |

*Primary Examiner*—Reinaldo P. Machado
*Attorney, Agent, or Firm*—Harpman & Harpman

[57] ABSTRACT

A mobile containment platform method and system for sandblasting and the like used in bridge reconditioning and painting that requires removal of paint from the support structure of the bridge. The containment platform provides a safe secure entrapment envelop for spent abrasive and removed paint residue.

6 Claims, 2 Drawing Sheets

PARTICULATE CONTAINMENT CONTROL METHOD AND PLATFORM DEVICE

BACKGROUND OF THE INVENTION

1. Technical Field

This method relates to bridge painting and cleaning support scaffolds that are used to enable workers to be supported safely from an overhead bridge support framework. In modern steel bridges, it is necessary to periodically clean and repaint the surface to prevent adverse corrosion and associated deteriation of the steel support structure. This type of maintenance is critical to the useful life of a bridge span to delay replacement, the cost of which is becoming in many instances an overwhelming burden for the local state and federal entities who are responsible for highway bridges which are critical to our transportation network.

Presently there is a growing concern for the contamination of the environment and need to contain and control the results of this work, such as paint residue when it is removed from the overhead bridge when is required before repainting.

The object of this method is to provide a safe, efficient method utilizing a lightweight and inexpensive containment platform that can be easily erected on sight that will contain the used sandblast abrasive and paint residue removed for collection and periodic removal without entering the environment.

2. Description of Prior Art

Prior Art devices of this type have generally been directed to safety scaffolding configurations used during construction for workers, see for example U.S. Pat. Nos. 3,533,487, 4,119,176 and 4,732,234.

Current attempts to provide a containment system have to date been cumbersome and expensive.

In U.S. Pat. No. 3,533,487 a safety scaffolding system is disclosed that provides a tilt warning inactivation device that automatically clamps the scaffolding to the cable when an angular indication is sensed. A safety net is provided below the scaffold and is maintained relative to the scaffold and the building as the scaffold ascends or descends during use.

U.S. Pat. No. 4,119,176 discloses a fall arrester for buildings under construction. The device moves in and is supported from a guide track temporarily secured to the framework of the building under construction. A main net support boom movable extends angularly from the track with a secondary interconnected boom engaging the track at a point therealong. A net extends from the track to the outer portion of the main net support boom providing a safety net for workers as they ascend the building during construction.

U.S. Pat. No. 4,732,234 discloses a perimeter safety net system for use on buildings under construction. The device uses a net support boom pivotally secured to a movable side rail within a channel affixed to the building.

SUMMARY OF THE INVENTION

A movable containment method and platform system that can easily be erected and moved beneath a bridge structure or the like that will catch and temporarily hold used sandblasting abrasive with intrained removed paint residue for a safe disposal. The containment platform system has a series of interlocking scaffolding elements from which is suspended containment catch tarps therebeneath and upwardly therefrom for engagement with the bridge support structure.

DESCRIPTION OF THE PREFERRED EMBODIMENT

Figure 6:
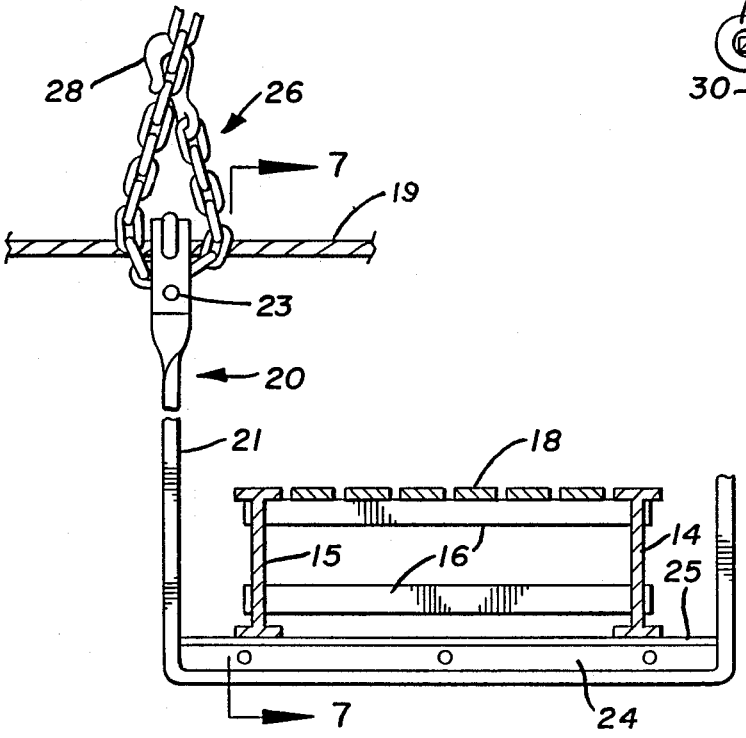
FIG. 6 is a cross-sectional view of a scaffold and scaffold support extending therefrom.

A self-contained mobile containment method and system for use on highway bridges 10 and the like comprises an interlocking grid of scaffolding elements 11 suspended in spaced parallel relation to the underside of a bridge framework 12. The grid of scaffolding elements 11 comprises main multiple spaced parallel stages 13 commonly used in the paint and repair industry. Each of the stages 13 is comprised of a pair of main support flange beams 14 and 15, with a plurality of spaced interconnected rung elements 16 extending between said beams with multiple deck channels 18 positioned thereon parallel with said beams, as will be well known and understood by those skilled in the art, see FIGS. 6 and 7 of the drawings. The stages 13 are positioned transversely of the bridge framework 12 initially on support cables 19 secured under the bridge framework 12 by modified cable hook assemblies 20. Referring now to FIGS. 2,6,7 and 8 of the drawings the cable hook assemblies 20 can be seen comprising a generally U-shaped flat bar member 21, the oppositely disposed free ends of which are twisted at 90° and returned on themselves to form an inverted J configuration that engages the support cable 19 on space bearings 22 with release pins 23 positioned in spaced parallel relation thereto. A stage support web 24 extends along horizontal position of the cable hook 20 with a pressure engagement plate 25 positioned longitudinally thereon for direct engagement of the flange beams 14 and 15 of the stages 13, best seen in FIG. 7 of the drawings. A support stage assembly 26 comprises a chain element 27 having oppositely disposed hooks 28 on its respective ends and a secondary hook 29 and support eylet 30. The support chain assembly 26 is attached ot the bridge framework 12 via a hooks 28 and the secondary hook and eylets 29 and 30 and extends through the inverted J configuration of the cable hook 20 below the cable 19, as best seen in FIG. 6 of the drawings. By use of the support chain assembly 26 and cable hook assemblies 20 they will support an increase load greater than that of the cable 19 alone. A plurality of shorter secondary stages 31 interconnect with the main stages 13 transversely of their longitudinal length to form the interlocking grid of the scaffolding elements 11 as noted above. Each of the secondary stages 31 are similar in construction to said main stages 13 having beams 32, cross connection rungs 33 and a decking 34.

Referring now to FIGS. 1,3,4, and 5 of the drawings a stage connection assembly 35 is disclosed comprising stage engagement brackets 36 consisting of apertured contoured plates 37 and lock bars 38. Each of the plates 37 are positioned on the respective sides of said beams 32 and are secured thereon by the lock bars 38 engaging the inner side of said beams 32 and are connected together via fasteners F extending therebetween.

Figure 3:
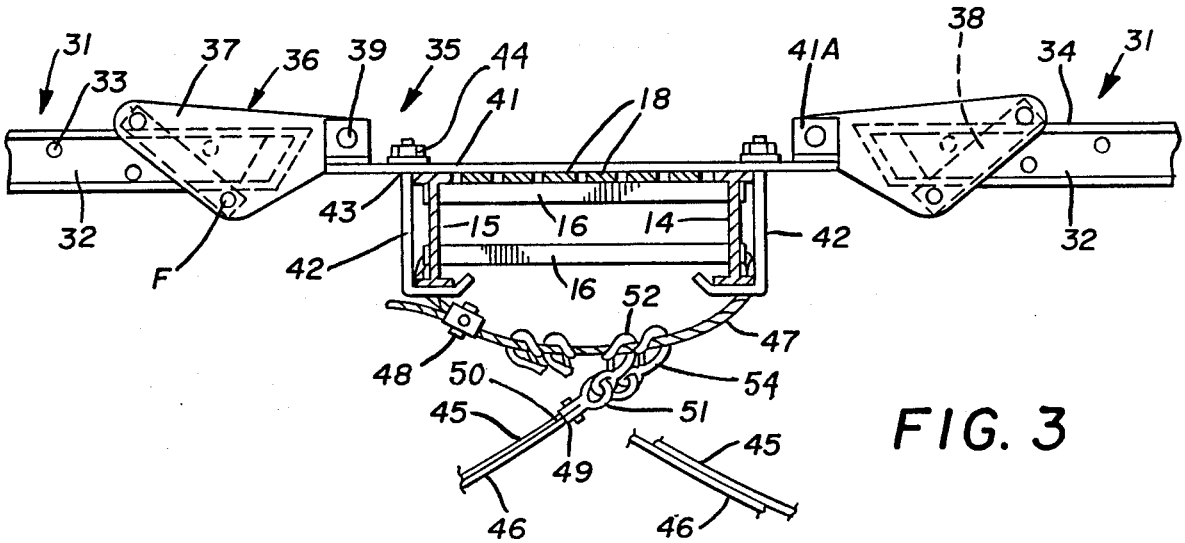
FIG. 3 is an enlarged cross-sectional view on lines 3—3 of FIG. 2 of the interlocking of adjacent scaffolding elements.
Figure 4:
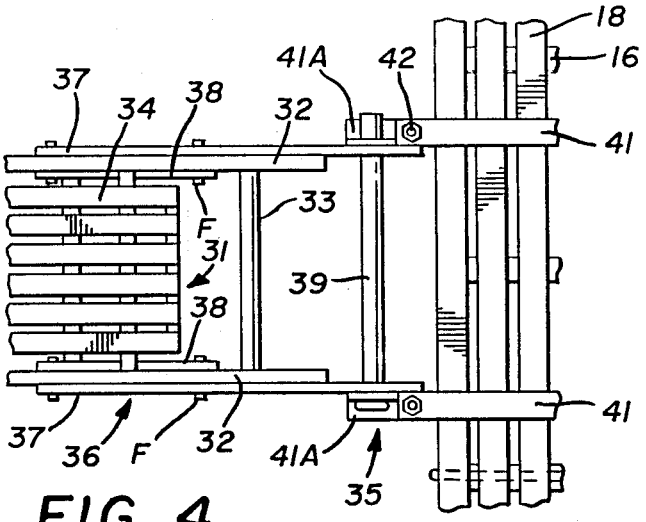
FIG. 4 is a partial top plan view of a scaffolding interconnection point.
Figure 7:
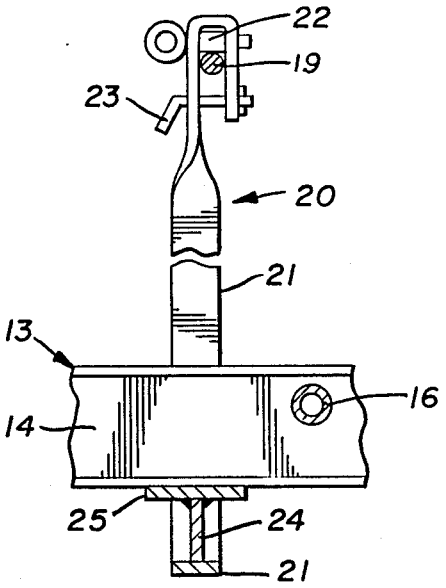
FIG. 7 is a section on lines 7—7 of FIG. 6.
Figure 5:
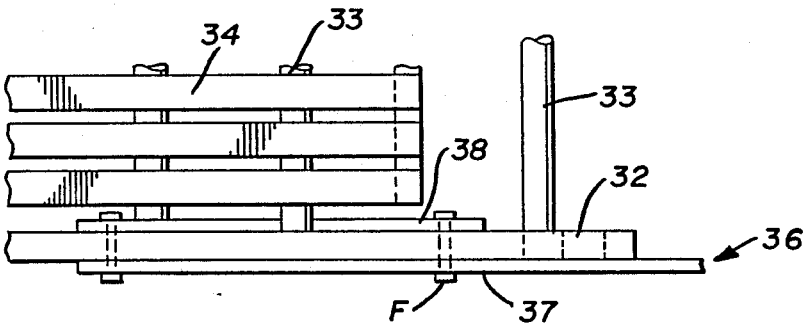
FIG. 5 is an enlarged top plan view of a portion of the interconnection points shown in FIG. 4.
Figure 8:
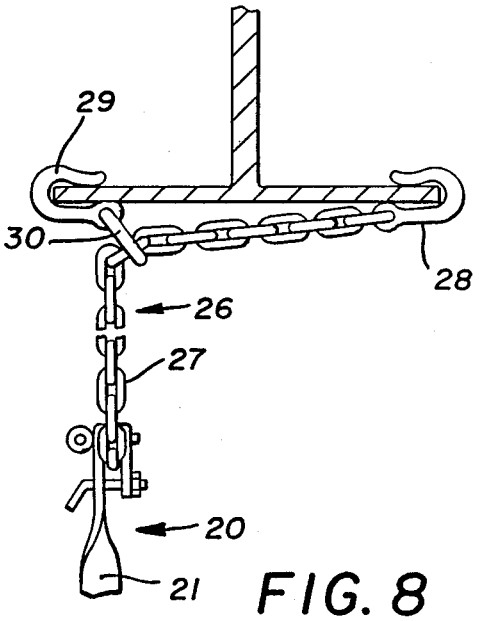
FIG. 8 is an enlarged view of an upper portion of the scaffolding support engaging a bridge support beam.

A tie support tubular member 39 extends through the aligned apertured free ends of said respective plates 37 providing a pair of spaced attachment points. The stage connection assembly 35 is comprised of a pair of flat bar connection members 41 each of which has an upstanding apertured angled 41A secured to its respective free ends. Each bar connection member 41 is secured transversely across said main stages 13 by J hooks 42 engaging under each of the flange beams 13 and 14 and extending vertically through apertures in said bar connection member at 43 with threaded fasteners 44 thereon, as best seen in FIGS. 3 and 4 of the drawings. Each of the flat connection members 41 thus positioned in spaced parallel relation to one another on the main stages 13 so as to be engaged at their apertured upstanding angles 41A over opposite ends of said tie support tubular member 39 from which is supported the respective secondary stages 31 in the interlocking fashion shown in FIG. 1 of the drawings.

Figure 1:
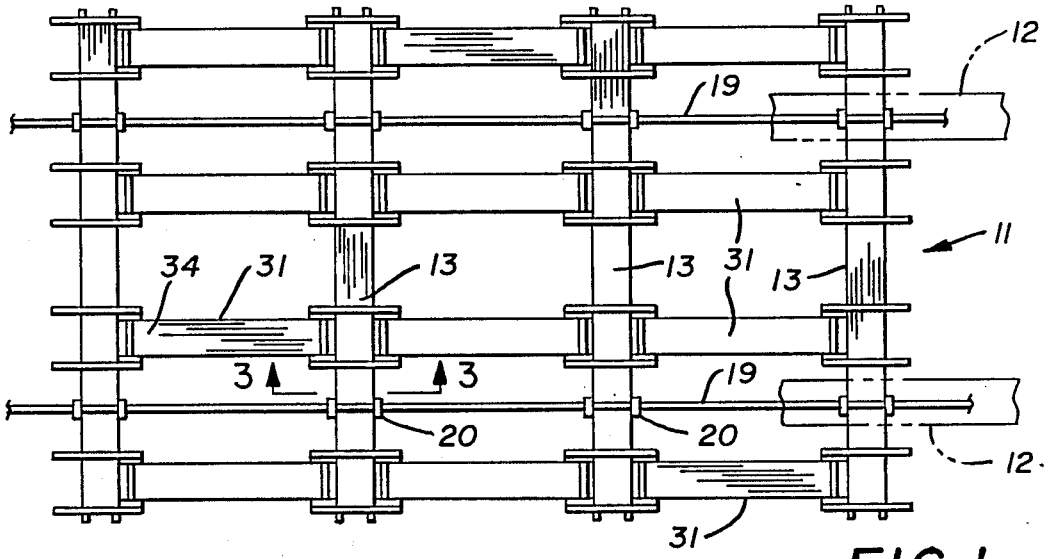
FIG. 1 is a top plan view of the support scaffold system elements.
Figure 2:
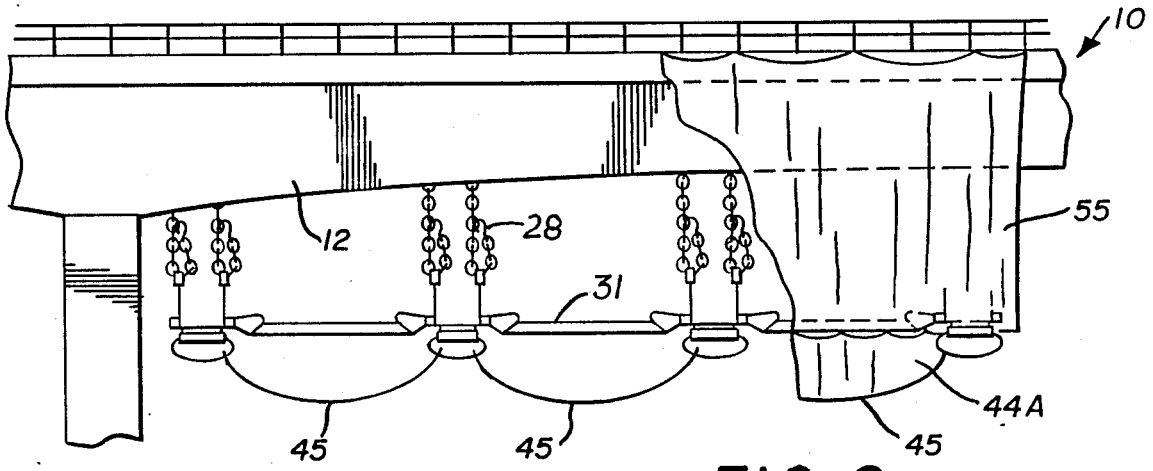
FIG. 2 is a side plan view of the containment platform suspended from a bridge structure.

Referring now to FIGS. 2 and 3 of the drawings spent abrasive catch tarps 45 can be seen draped between and secured to the main support stages 13 are removably secured to a cable assembly 47 that extends through one of the rungs 16 at two foot intervals in the staging 13 in a closed loop formed by a cable connecter 48 secured thereon. The catch tarps 45 have a plurality of spaced eyelets 49 along their perimeter edged which are reinforced by an additional strip of material 50 extending along the perimeter edge of the tarps 45. A hasp 51 is bolted to each of the spaced eylets 49 and is engaged by a quick release hook 52 extending therefrom for removable engagement on the cable assembly 47. A plurality of tarp straps 46 having hooks 54 in each end thereof is of a reinforced fabric material and are positioned transversely under the abrasive tarps 45 at spaced intervals extending between the hereinbefore described cable assemblies 47. It should be noted that the relative spacing between each tarp strap 46 is generally twice that of said spacing of said tarp eyelets 49. Referring now to FIG. 2 of the drawings, the tarps 45 can be clearly seen with their respective ends 44A being pulled up and secured to the secondary staging 31 via the eyelets 49 and associated hasp and hooks 51 and 52 respectively as hereinbefore described.

A plurality of vertically ascending containment walls 55 extend from the upper portion of the bridge 10 downwardly to a point terminating within the perimeter of the horizontal containment area defined by the tarps 45 and associated interlocking structure 11.

In use, the containment platform can easily be erected on the bridge and moved along as the sandblasting of the bridge framework 12 progresses in preparation for painting. The spent abrasive (not shown) will be contained within the containment area and specifically collected within the draped tarps 45. Periodically during the sandblasting and containment collection the spent abrasive and intrained removed contaminated paint particles, etc. are removed from the tarps 45 to prevent overloading of the containment platform.

It will thus be seen that a new and novel contamination and containment method and platform device has been illustrated and described and that an efficient collection method for spent abrasive sand and remove paint matter within a environmentally controlled area without contamination of the surrounding environment has been achieve. It will be obvious to those skilled in the art that changes and modifications may be made therein without departing from the spirit of the invention. Therefore I claim:

We claim:

1. A method of establishing a self-contained mobile containment area under an existing structure for the capture and removal of spend sandblast abrasive and intrained contaminate within, the method comprising defining an enclosed space beneath and connected to the structrue using the existing structure support elements to define at least one portion of said enclosed space, establishing a support and containment interlocking platform grid supported by multiple pairs of spaced cable hook assemblies from said structure, sealing said enclosed space between said interlocking platform grid and said structure support, removing the spent sandblast abrasive and entrained contaminate from said enclosed space.

2. The method of establishing a self-contained mobile containment area beneath the structure of claim 1 wherein said support containment interlocking platform grid is comprised of multiple spaced parallel stage elements and interconnected right angularly extending secondary stage elements.

3. The method of claim 1 wherein said containment area includes catch tarps suspended between some of said interlocking platform elements.

4. The method of claim 1 further comprising erecting temporary wall means to define said enclosed space from said interlocking platform to said structure.

5. A system for establishing a self-contained mobile containment area, said system comprises a platform means suspended from a structure, said platform means including spaced multiple interconnecting support elements suspended in spaced relation under a structure, means for interlocking said spaced multipled support elements, means for moving said platform means relative said structure, sealing means for sealing said containment area between said platform means and said structure.

6. A system of claim 5 wherein means for interlocking said spaced multiple support elements to one another comprises engagement brackets, tie supports, cross fitting means and associated fasteners.

* * * * *